United States Patent [19]

Ishihara

[11] 4,350,033

[45] Sep. 21, 1982

[54] METHOD AND MECHANISM FOR CONSTANT-MEASURE FEED OF ROD MATERIALS

[76] Inventor: Masamitsu Ishihara, 628 Hirai, Kannami-cho, Tagata-gun, Shizuoka-ken, Japan

[21] Appl. No.: 162,423

[22] Filed: Jun. 24, 1980

[30] Foreign Application Priority Data

Dec. 27, 1979 [JP] Japan ..... 54-172001
Dec. 27, 1979 [JP] Japan ..... 54-172002
Mar. 25, 1980 [JP] Japan ..... 55-39249[U]

[51] Int. Cl.[3] ..... B21D 43/26

[52] U.S. Cl. ..... 72/24; 72/217; 72/428; 72/149

[58] Field of Search ..... 72/217, 216, 218, 149, 72/10, 8, 31, 215, 428, 21, 133, 22, 251, 74, 26, 27

[56] References Cited

U.S. PATENT DOCUMENTS 1,512,002 10/1924 Kardong ..... 72/217 X
2,627,890 2/1953 Lloyd et al. ..... 72/27
2,956,609 10/1960 Shaw, Jr. ..... 72/217
3,336,776 8/1967 Zerlaut ..... 72/11
3,393,543 7/1968 Van Gelder ..... 72/26
3,580,023 5/1971 Merrill et al. ..... 72/22
3,766,764 10/1973 Ross et al. ..... 72/8 X
3,974,676 8/1976 Eaton ..... 72/27

FOREIGN PATENT DOCUMENTS 2134652 2/1973 Fed. Rep. of Germany .

*Primary Examiner*—Lowell A. Larson
*Attorney, Agent, or Firm*—Schwartz, Jeffery, Schwaab, Mack, Blumenthal & Koch

[57] ABSTRACT

A method for constant-measure feed of rod materials comprising a process for bringing a feed member fixed to conveyor into contact with the rear ends of rod materials and conveying the rod materials together with the feed member along guide by the conveyor, a process for causing the forward ends of the rod materials to abut against a movable stopper disposed in a normal position and further conveying the rod materials while holding the rod materials between the stopper and the feed member, and a process for sensing a movement of the stopper for a given distance from the normal position and stopping the conveying operation of the conveyor.

16 Claims, 23 Drawing Figures

METHOD AND MECHANISM FOR CONSTANT-MEASURE FEED OF ROD MATERIALS

BACKGROUND OF THE INVENTION

This invention relates to a method and mechanism for constant-measure feed of rod materials to feed rod materials for predetermined length.

Pipes, round bars, reinforcing bars, shape steel and other rod members (hereinafter referred to as rod materials) are formed into standardized lengths. Users produce their desired rod materials by subjecting rod materials they purchased to some machine work such as cutting, bending or the like. Manufacturers of machines, for example, produce many pieces of shape steel with a predetermined length by feeding the shape steel purchased for such predetermined length by suitable conveyor means and repeating cutting operation, and utilize each piece of shape steel for the frame of machines. Further, reinforcing bars for reinforced concrete are processed into various desired shapes, such as the shapes of L, channel or the like by bending them after feeding them for a predetermined length by means of conveyor means.

In a prior art constant-measure feed mechanism for rod materials, rod materials are set directly on conveyor means, and moved distance of the conveyor means itself is sensed. The rod materials are fed for a predetermined length by stopping the conveyor means when it is moved for such predetermined distance. With such conventional construction, tolerances of movement of the conveyor means are accumulated in subjecting the rod materials to a number of machining processes, so that it is difficult to obtain satisfactory processing accuracy. Moreover, if there is any gap between a feed member fixed to the conveyor means and the rear ends of the rod materials, the rod materials will slip on the conveyor means to make the feed distance of the rod materials different from the moved distance of the conveyor means. In setting the rod materials on the conveyor means, therefore, the rear ends of the rod materials must be positively pressed against the feed member to leave no gap therebetween. Thus, the setting of the rod materials on the conveyor means would be a hard task.

SUMMARY OF THE INVENTION

It is therefore an object of this invention to provide a method and mechanism for constant-measure feed of rod materials eliminating the aforementioned drawbacks of the prior art.

In order to attain the above object, according to this invention, a feed member fixed to conveyor means engages the rear ends of rod materials, and the forward ends of the rod materials abuts against a movable stopper. The rod materials are conveyed by the conveyor means while being held between the feed member and the stopper, and the conveying operation of the conveyor means is stopped when the stopper is moved for a predetermined distance from its normal position.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENT

Now there will be described a preferred embodiment of this invention with reference to the accompanying drawings.

Figure 1:
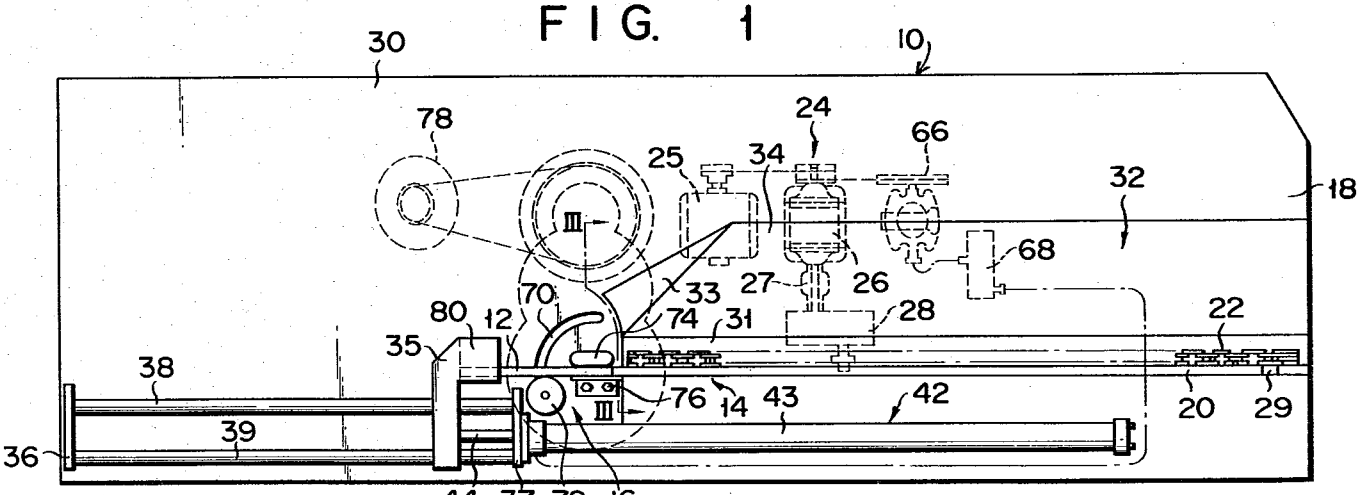
FIG. 1 is a schematic top plan view of a bending machine provided with a constant-measure feed mechanism according to a preferred embodiment of this invention.
Figure 2:
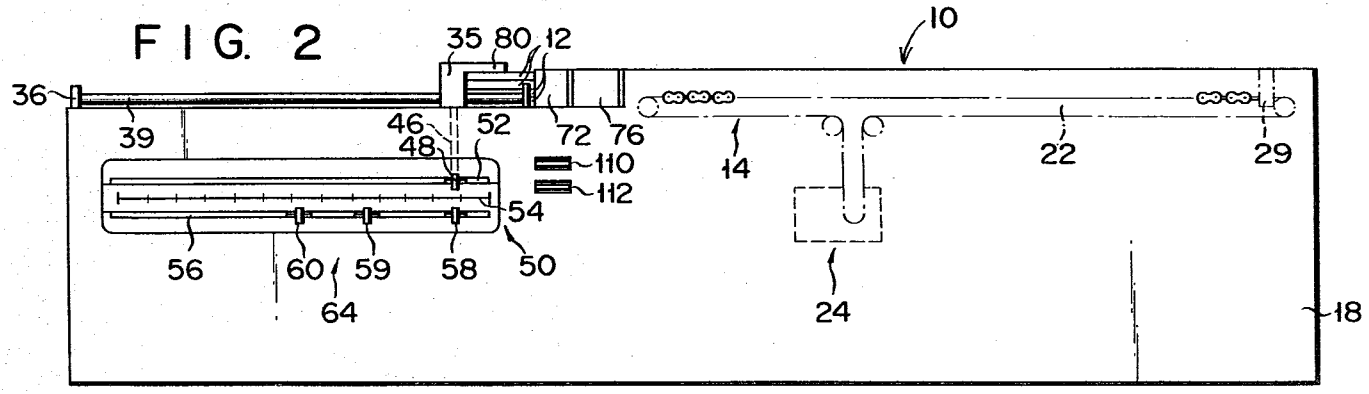
FIG. 2 is a schematic front view of the bending machine of FIG. 1.

As an example of practical application of the constant-measure feed mechanism for rod materials of this invention, there will now be described a case where the feed mechanism is applied to a bending machine. In FIGS. 1 and 2, a bending machine 10 is provided with a constant-measure feed mechanism 14 for rod materials 12 according to a preferred embodiment of this invention and a bending mechanism 16 for bending to a predetermined angle the rod materials 12 fed for a predetermined length by the constant-measure feed mechanism 14.

The constant-measure feed mechanism 14 includes an open-top channel-shaped guide 20 containing the rod materials 12 and disposed, for example, on the top surface of a housing 18, and a conveying member 22 formed of e.g. a reversible endless chain running parallel with the guide 20. The guide 20 is wide enough to allow the rod materials 12 to be loosely fitted therein and high enough to hold several, e.g. four, such rod materials at a time. The conveying member 22 is so constructed as to be advanced or reversed by the driving force of a power source 24. The power source 24 includes a motor 25, first gear box 26, clutch 27 with brake, and second gear box 28. The conveying member 22 further includes a feed member 29 attached to the chain and extending sideways. The feed member 29 penetrates the guide 20 through an opening thereof and is so designed as to be able to abut the rear ends of the rod materials 12.

Figure 3:
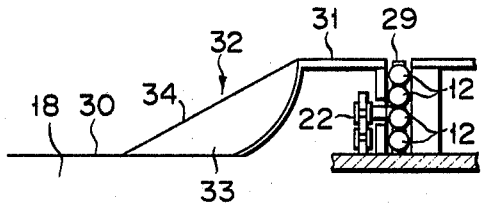
FIG. 3 is a partially sectional view of a housing along the line III—III of FIG. 1.

As shown in FIGS. 1 and 3, the top surface of the housing 18 is stepped form, including first and second horizontal planes 30 and 31. The first horizontal plane 30 forms a sliding surface on which bent portions of the rod materials 12 are slidden by means of a bending roller, and the first and second horizontal planes 30 and 31 are connected by a slope 32. The slope 32 is formed of a curved first sloping plane 33 and a second sloping plane 34. The slope 32 need only have such an angle of inclination that the bent portion of the rod materials 12 will never run against part of the rod materials 12 within the guide 20 when the rod materials 12 are bent until they intersect themselves, and the location and length of the slope 32 may suitably be determined in consideration of the height of the rod materials 12 and the length of the bent portions.

As shown in FIG. 1, the constant-measure feed mechanism 14 further includes a stopper 35 disposed in a normal position, for example, in front of the conveying member 22 in the conveying direction thereof. The stopper 35 is slidably supported by a pair of support bars 38 and 39 stretched between a pair of upright posts 36 and 37 which are fixed on the top surface of the housing 18. The stopper 35 is coupled with the free end of a piston rod 44 which slides inside a cylinder 43 of a pneumatic cylinder unit 42 disposed on the top surface of the housing 18. Normally, the stopper 35 is located in the normal position, biased thereto by the pneumatic cylinder unit 42. A hydraulic cylinder unit may be used in place of the pneumatic cylinder unit 42. In FIG. 2, the pneumatic cylinder unit 42 is omitted for simplicity. As shown in FIG. 2, a rod 46 extends downward from the stopper 35, and a slider 48 is fixed to the bottom end of the rod 46. The slider 48 is slidably fitted in an opening 52 of an indicator 50 formed at the front part of the housing 18. Also, another opening 56 is formed in the indicator 50 under the opening 52, a scale 54 being positioned between the openings 52 and 56. A plurality of constant-measure gauges, e.g. three gauges 58, 59 and 60, are slidably fitted in the opening 56.

Figure 4:
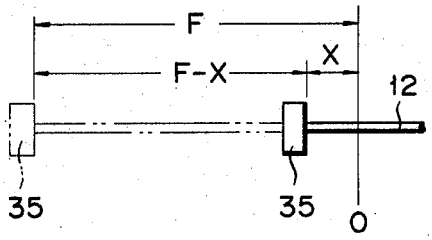
FIG. 4 is a schematic diagram showing the relationship between the feed distance of the rod materials and the moved distance of the stopper.

Referring now to FIG. 4, there will be described the relationship between the feed distance of the rod materials 12 and the moved distance of the stopper 35. In feeding the rod materials 12 for a predetermined length to bend them for a bending length F (equal to the length of bent portions of the rod materials), the stopper 35 need only be moved by a distance (F–X) where X is the distance between a reference point 0 and the normal position of the stopper 35. That is, the moved distance of the stopper 35 from its normal position is not coincident with the desired feed distance of the rod materials 12. However, the important value for the constant-measure feed mechanism 14 is the constant-measure value or the bending length F, and the distance from the reference point is marked on the scale 54.

The constant-measure gauges 58, 59 and 60 constitute a sensing member 64 which senses the movement of the stopper 35 for the aforesaid distance (F–X) from the normal position and cuts off the supply of driving force to the conveying member 22 to stop the operation thereof. The sensing member 64 can have the form of, for example, a limit switch or nocontact sensor. In the sensing member of the embodiment shown in FIGS. 1 and 2, however, a light emitting element is disposed at the bottom portion of the rod 46, and light sensing elements are provided respectively for the constant-measure gauges 58, 59 and 60.

The driving force from the motor 25 is transmitted to a pump 66 through the first gear box 26, and high-pressure air pressurized by the pump 66 is supplied to the pneumatic cylinder unit 42 through an air tank 68. The supply of the high-pressure air is so controlled as to apply constant biasing force to the stopper 35.

The rod materials 12 fed for the predetermined length by the constant-measure feed mechanism 14 are bent by the bending mechanism 16. The bending mechanism 16 includes a bending roller 72 which moves in an arcuate slot 70 formed in the sliding surface 30 of the housing 18. The bending roller 72, guided by a bending guide 74, can bend the rod materials 12 at a predetermined angle, e.g. 90°. Facing the bending guide 74 a block 76 is provided for preventing the rod materials 12 from escaping sideways at bending. The driving force for the bending roller 72 is transmitted from a power source, such as a motor 78 (FIG. 1) disposed inside the housing 18 to the bending roller 72. The bending roller 72, bending guide 74 and block 76 are high enough to enable simultaneous bending of a plurality of, e.g. four, rod materials 12. The bending guide 74 has a rotatable or unrotatable guide roller so that the rod materials 12 are held between the guide roller and the bending roller.

Figure 5:
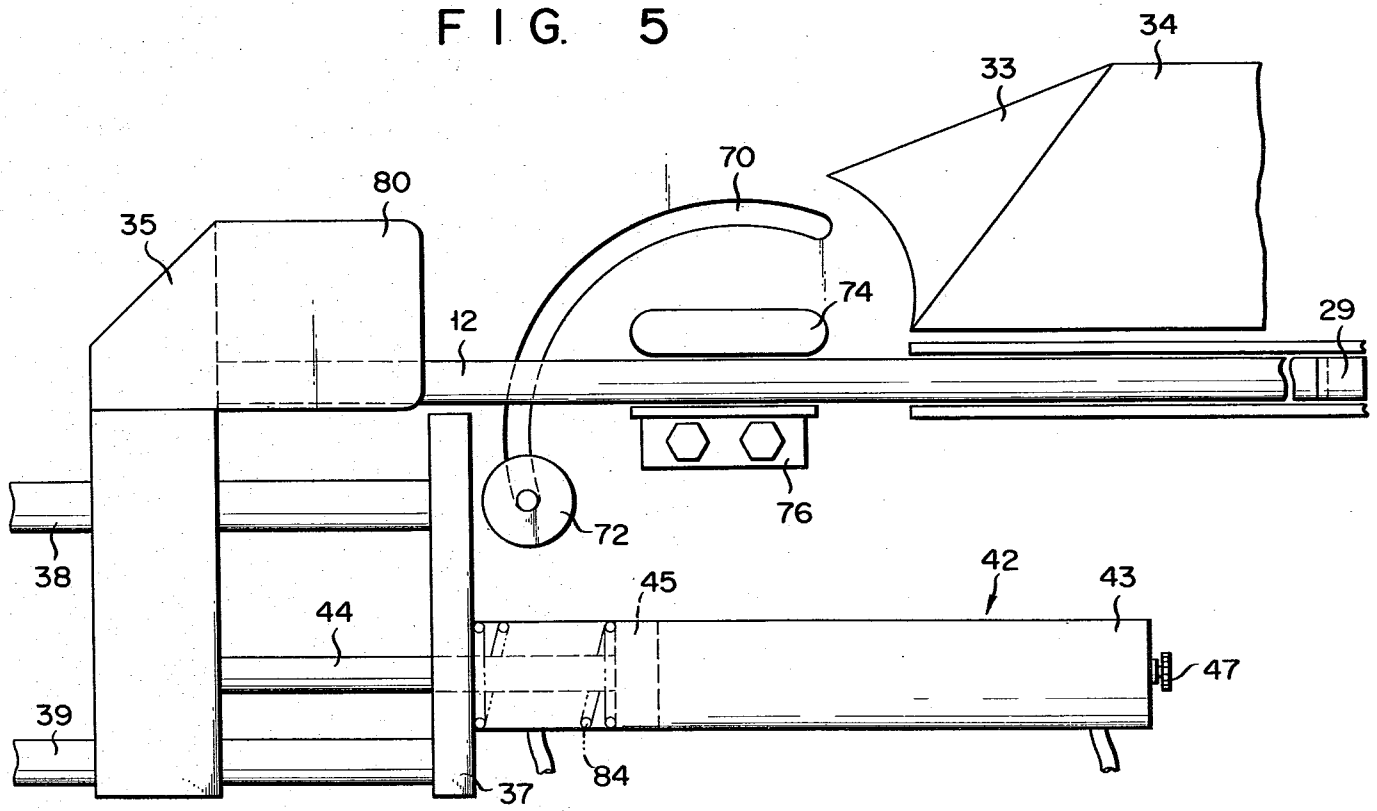
FIG. 5 is an enlarged top plan view showing part of the bending machine of FIG. 1, in which the rod materials being not bended yet.
Figure 6:
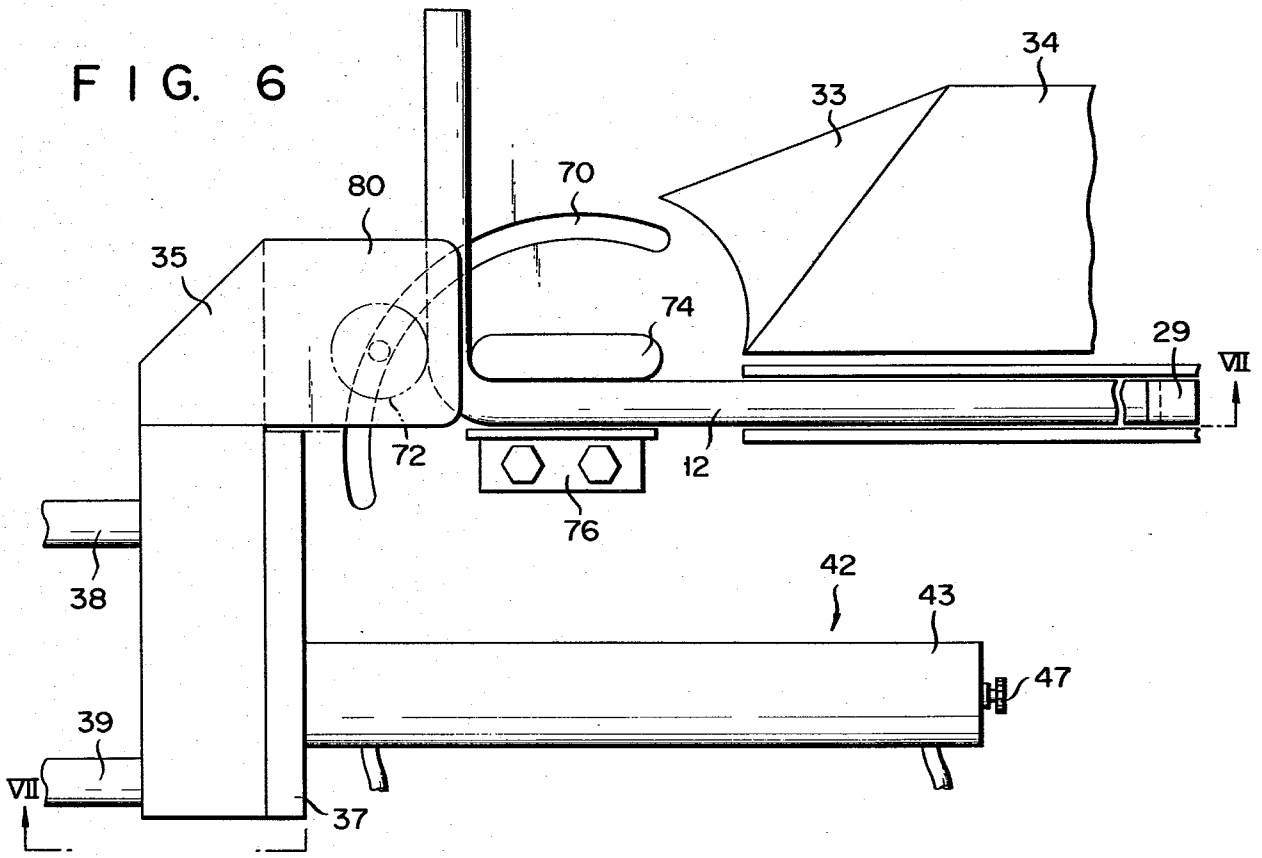
FIG. 6 is an enlarged top plan view similar to FIG. 5, in which the rod materials have been bended.
Figure 7:
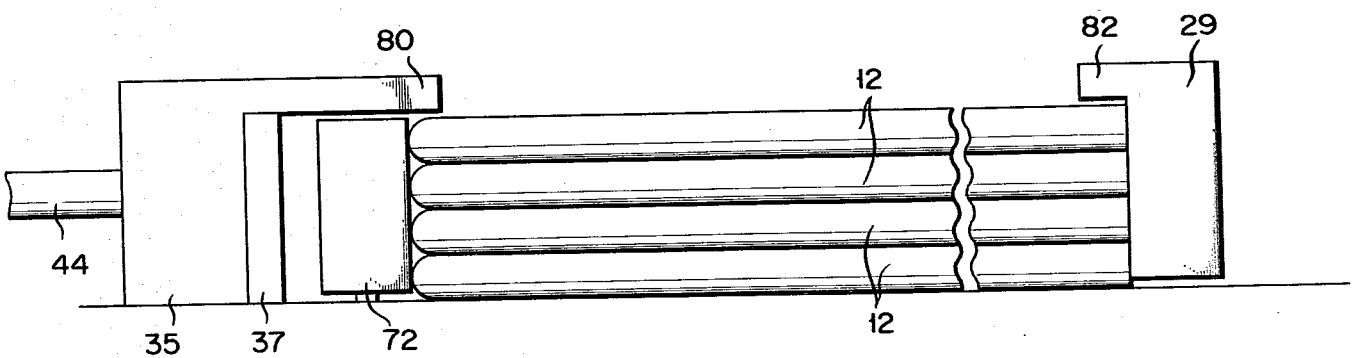
FIG. 7 is a front view along the line VII—VII of FIG. 6.

As shown in FIG. 5, the stopper 35 has a pressure plate 80 covering the top portion of the rod materials 12. As described above, the biasing force to bias the stopper 35 to its normal position is applied from the pneumatic cylinder unit 42 to the stopper 35. Accordingly, if the rod materials 12, bent by the bending roller 72, tend to leave the stopper 35, the stopper 35 will follow up the movement of the rod materials 12 to move toward the normal position. Further, the stopper 35 continually covers the top of the rod materials 12 by means of the pressure plate 80 (see FIGS. 6 and 7), so that the rod materials 12 are perfectly prevented from escaping upward or being twisted. As shown in FIG. 7, moreover, it is preferable to form a pressure plate 82 for the same purpose also on the feed member 29.

The pressure plate 80 of the stopper 35 will be an obstacle to the removal of the rod materials 12 after processing. To eliminate such obstacle, it is to be desired that pressure air should be supplied to chambers on both sides of a piston head 45 and that there should be provided a valve 47 for discharging air inside the right-hand chamber into the atmosphere, as shown in FIG. 5. When the pressure air is supplied to both these chambers, urging force to bias the stopper 35 to the right acts on the stopper 35 through the piston rod 44, and the stopper 35 comes in contact with the upright post 37 to be kept in the normal position (see FIG. 6). In such construction, when the forward ends of the rod materials 12 run against the stopper 35 to move the stopper 35 therewith to the left, the air inside the left-hand chamber is pressurized to produce biasing force to push back the stopper 35 to the right. Thus, the rod materials 12 can securely be aligned and held between the feed member 29 and the stopper 35. Since there always exists the biasing force to push back the stopper 35 to the normal position, the stopper 35 must be moved to the left against such biasing force in removing the rod materials 12 after processing. After bending, therefore, pressure air under higher pressure than the air in the left-hand chamber is supplied to the right-hand chamber to forcedly move the stopper 35 to the left for the removal of the rod materials 12. After the processed rod materials 12 are removed, the valve 47 is opened to discharge the pressure air in the right-hand chamber into the atmosphere, thereby restoring the stopper 35 to its normal position where it is in contact with the upright post 37.

As mentioned before, the pneumatic cylinder unit 42 may be replaced by a hydraulic unit. In this case, a compression coil spring 84 is preferably disposed inside the left-hand chamber, as represented by imaginary lines in FIG. 5.

Figure 8A:
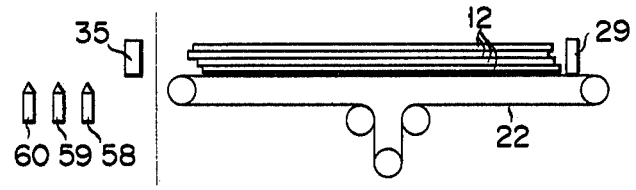
FIGS. 8A to 8F are schematic diagrams showing a method for constant-measure feed of this invention.
Figure 8B:
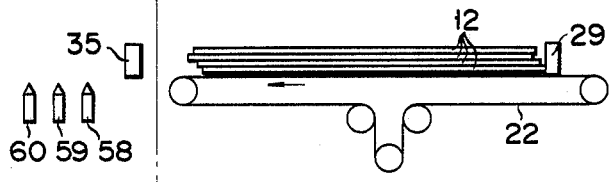
Figure 8C:
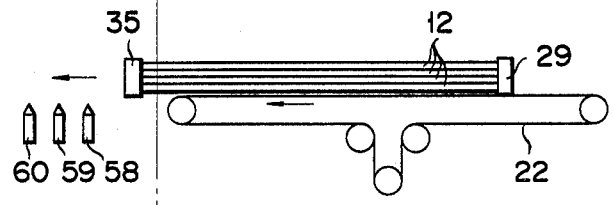
Figure 8D:
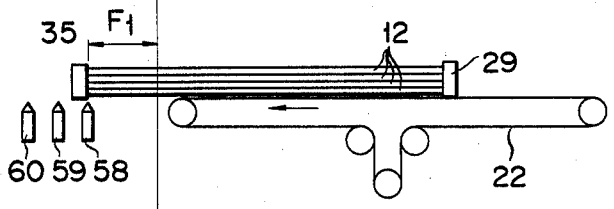
Figure 8E:
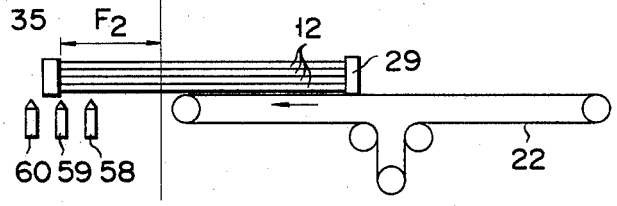
Figure 8F:
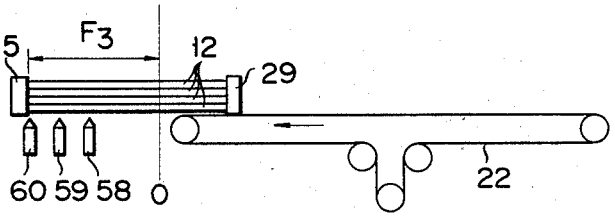
Figure 9A:
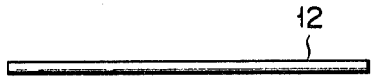
FIGS. 9A to 9D are diagrams showing the shape of each rod material at the end of the bending process.
Figure 9B:
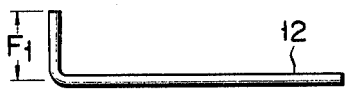
Figure 9C:
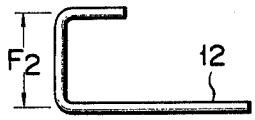
Figure 9D:
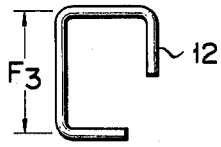

Referring now to FIGS. 8A to 8F, there will be described a method for constant-measure feed of this invention. First, as shown in FIG. 8A, the rod materials 12, e.g. four in number, are put in the guide 20. Thereafter, when the conveying member 22 is operated, the feed member 29 of the conveying member 22 abuts against the rear ends of the rod materials 12 (see FIG. 8B) to move together with the rod materials 12. When the conveying member 22 is further operated, the forward ends of the rod materials 12 run against the stopper 35 (see FIG. 8C). At this time, the stopper 35 is subjected to biasing force toward the normal position by the pneumatic cylinder unit 42, so that the rod materials 12 are firmly held between the stopper 35 and the feed member 29, and hence are completely aligned even if they are put in irregularly. When the stopper 35 is moved for example a distance ($F_1$–X) from the normal position to feed the rod materials 12 by $F_1$ from the reference point 0 (see FIG. 8D), the constant-measure gauge 58 senses the passage of the stopper 35 and cuts off the driving force from the conveying member 22 to stop the operation thereof. Thereafter, the bending roller 72 is driven for desired bending operation. Continually subjected to the biasing force toward the normal position, the stopper 35 will automatically return to the normal position when the rod materials 12 leave the stopper 35 at bending. At the end of a first bending process, each rod material 12, originally having the shape as shown in FIG. 9A, is formed into the shape as shown in FIG. 9B, for example. When the first bending process is completed, the driving force is again transmitted to the conveying member 22, and the feed member 29 is advanced further from the position shown in FIG. 8D while holding the rod materials 12 between itself and the stopper 35. When the feed member 29 is moved for a distance ($F_2$–$F_1$) from the position of FIG. 8D, the stopper 35 is moved for a distance ($F_2$–X) from the normal position, and the rod materials 12 are advanced by $F_2$ from the reference point O (FIG. 8E). Accordingly, the constant-measure gauge 59 senses the passage of the stopper 35 and stops the operation of the conveying member 22. When a second bending process is executed in the same manner as aforesaid, the rod materials 12 are processed as shown in FIG. 9C. Thereafter, when the conveying member 22 is further operated to move the feed member 29 for a distance ($F_3$–$F_2$) from the position shown in FIG. 8E, the rod materials 12 are advanced by $F_3$ from the reference point O, in the end. Moreover, the constant-measure gauge 60 senses the passage of the stopper 35 and stops the operation of the conveying member 22 for a third bending process. Undergoing the first to third bending processes, the rod materials 12 are finally processed into the shape as shown in FIG. 9D, and thus a predetermined cycle is finished. After such cycle is completed, the processed rod materials 12 are removed from the guide 20, and the conveying member 22 is driven reversely to return the feed member 29 to its initial position shown in FIG. 8A. When the rod materials 12 are removed from the guide 20, the stopper 35 is automatically restored to the normal position by the biasing force of the pneumatic cylinder unit 42, and thus all the preparations for the next cycle are made. By repeating the aforesaid cycle with additional sets of rod materials 12 put in the guide 20, such rod materials 12 as shown in FIG. 9D are produced successively. It is a matter of course that the processing shape shown in FIG. 9D is nothing but an example.

Although in the above embodiment the bending machine 10 is formed by combining the constant-measure feed mechanism 12 of this invention with the bending mechanism 16, it is to be understood that the contact-measure feed mechanism 12 of the invention is not limited to such embodiment, and may also be applied to various other fields.

Since mechanisms for successively providing the constant-measure gauges 58, 59 and 60 with the sensing faculty and for advancing reversing the conveying member 22 according to predetermined procedures can easily be obtained with use of conventional electric circuits, they will not expressly be described herein.

Figure 10:
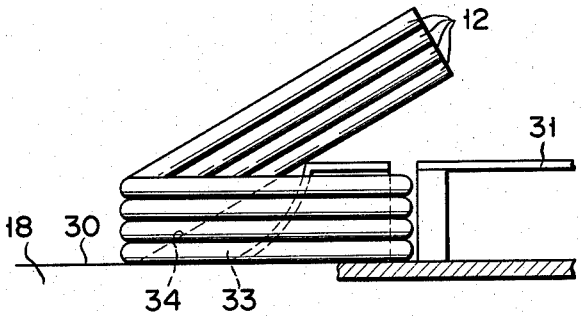
FIG. 10 is a partially sectional view of the housing similar to FIG. 3, in which the bent portions of the rod materials being passing over the rod materials.

According to the ilustrated bending machine 10, as described above, the sliding surface 30 is provided with the slope 32 which can force up the bent portions of the rod materials 12 bent by the bending roller 72, the slope 32 having such an angle of inclination that the bent portions being forced up may pass over part of the rod materials 12 on the conveying member 22. In bending, therefore, the bent portions are pushed against the slope 32 and forced up by the bending roller 72, passing over part of the rod materials 12 on the conveying member 22 (see FIG. 10). Thus, if the rod materials 12 are bent until they intersect themselves, the bent portions will never run against the remaining portions of the rod materials 12. Since the bent portions are forced up along the slope 32 automatically by the bending roller 72, a series of bending operations may continuously be performed without a break, ensuring higher productivity and uniformity of shape in bent products.

Moreover, the aforementioned construction has no dependence on human power, so that a plurality of rod materials may simultaneously be bent into the same shape by means of the bending roller by arranging the rod materials vertically in the guide 20 in conveyance, thereby further improving the productivity.

Figure 11:
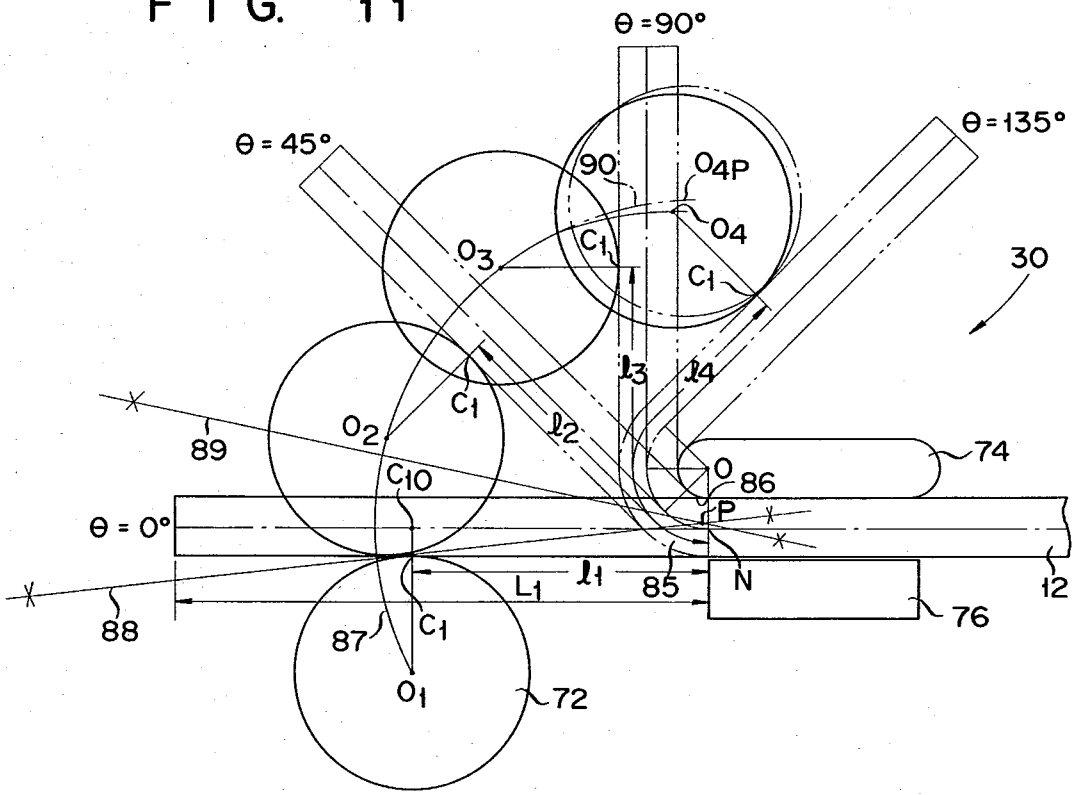
FIG. 11 is a diagram showing a curve along which a bending roller of the bending machine revolves.

In a prior art bending machine, rod materials tend to slip due to sliding force caused between a bending roller and the rod materials, thereby increasing the bending length of the rod materials after processing as compared with the length expected before processing. In the bending machine 10 as illustrated, however, the bending roller 72 revolves around the bending guide 74 so as not to cause the rod materials 12 to slip. Namely, as shown in FIG. 11, the bending roller 72 revolves along such a curve that a contact point $C_1$ between the bending roller 72 and each rod material 12 may be a fixed point on the rod material 12, bending the rod material not about the center of an arcuate guide surface 86 of the bending guide 74. This curve may be obtained as a locus of the center of the bending roller 72 which is located on a straight line intersecting at right angles to the neutral axis of the rod material 12, e.g. a reinforcing bar, at a predetermined distance (e.g. $l_1$) from the neutral axis origin N of the bent portion 85. That is, the bending roller 72 revolves along the illustrated curve relatively to the bending guide 74 so that the distance on the neutral axis is fixed. When the bending roller 72 is rotated in this manner, the contact point between the reinforcing bar 12 and the bending roller 72 is always coincident with the contact point $C_1$ or fixed point where the bending angle $\theta$ is $\theta=0°$. Therefore, there is no room for any sliding force between the reinforcing bar 12 and the bending roller 72, so that the reinforcing bar being bent can be prevented from slipping and the bending length $L_1$ of the reinforcing bar can be maintained constant.

As a specific example, the locus of the bending roller 72 may be obtained as follows. Suppose the radius of curvature of the guide surface 86 to be 5 mm, the diameter of the reinforcing bar 12 to be 10 mm, the diameter of the bending roller 72 to be 40 mm, the distance ($=l_1$) between the contact points to be 50 mm, and the bending length ($=L_1$) of the reinforcing bar 12 to be 90 mm.

TABLE 1

| Bending angle ($\theta$) | Distance between contact points (mm) | | |
|---|---|---|---|
| | l | Length of arcuate section | Length of straight section |
| 0° | $l_1$ | 0 | 50 |
| 45° | $l_2$ ($= l_1$) | 7.9 | 42.1 |
| 90° | $l_3$ ($= l_1$) | 15.8 | 34.2 |
| 135° | $l_4$ ($= l_1$) | 23.7 | 26.3 |

As shown in Table 1, the location of the contact point $C_1$ for each bending angle is decided by setting the length of the straight portion on the neutral axis at each bending angle. When circles with a diameter of 40 mm in contact with the reinforcing bar 12 at several contact points $C_1$ are drawn, the centers of the circles correspond respectively to the centers $O_2$ to $O_4$ of the bending roller 72. Thus, a curve passing through the centers $O_1$ to $O_4$ of the bending roller 72 may be obtained as a locus 87 of the bending roller.

As clear from FIG. 11, the locus 87 of the bending roller 72 generates a sophisticated curve other than a true circle. Thus, the locus 87 can be obtained by accurately detecting a curve passing through the center of the bending roller 72 which is calculated by fractionizing the bending angle in the aforesaid manner. By revolving the bending roller 72 along the profile of a template formed corresponding to the locus 87, bending can be achieved without any slip caused by the bending roller 72, and the increase of the bending length can be prevented.

According to applicable standards in the art, e.g. Standard Specifications for Construction Work issued by Architectural Institute of Japan, however, a tolerance of ±5 mm is allowed for the bending length of a reinforcing bar, so that an approximate locus of a true circle may be used instead of the accurate locus 87. Hereupon, it is to be understood that the approximate locus of the true circle, as compared with the accurate locus 87, need be within a given tolerance.

The approximate locus of the true circle may, for example, be obtained as follows. It is known by experience that a slip of a workpiece in bending is caused where the bending angle $\theta$ is smaller than 90°, and that such slip is noticeable where the bending angle $\theta$ ranges from 0° to 45°. Prevention of the slip at the bending angle $\theta=45°$, for example, is considered to be able to restrict slips at other bending angles within the tolerance. The center of the approximate locus of the true circle, i.e. bending center, of the bending roller 72 which causes no slip at the bending angle $\theta=45°$ is located on a straight line 88 which is a perpendicular bisector of a segment connecting the centers $O_1$ and $O_2$ of the bending roller 72 at the bending angles $\theta=0°$ and 45°, respectively. Here the bending center on the straight line 88 seems to need only fulfill the following requirements.

(1) Slip of the reinforcing bar at each bending angle should be within the tolerance.

This requirement can be regarded as substantially fulfilled if the deviation of the center on the approximate locus from its corresponding center on the theoretical locus at each bending angle is within the tolerance. If the bending angle $\theta$ exceeds 90°, resisting force is produced by the bent portion 85 of the reinforcing bar 12 around the fixed guide 32 to prevent the slipping of the reinforcing bar, so that this requirement can be ignored.

(2) Where the bending angle $\theta$ exceeds 90°, the greater the radius R of curvature of the approximate locus, the closer to the free end of the reinforcing bar 12 draws the contact point between the bending roller 72 and the reinforcing bar 12. If the radius R of curvature exceeds a certain limiting value, the bending roller 72 revolves without touching the reinforcing bar 12. As the bending roller 72 approaches and touches the free end of the reinforcing bar 12, moreover, the reinforcing bar 12 comes to leave the guide surface 86, possibly providing a bent portion with inaccurate bending angle. Accordingly, the radius R of curvature need be set within such a range that the bending roller 72 may always revolve in contact with the reinforcing bar without causing the reinforcing bar to leave the guide surface.

(3) Where the bending angle $\theta$ exceeds 90°, the smaller the radius R of curvature, the farther away from the free end of the reinforcing bar 12 goes the contact point between the bending roller 72 and the reinforcing bar 12. Theoretically, the angle of revolution of the bending roller 72 for a unit bending angle is reduced, so that the bending roller 72 must be revolved beyond the theoretical revolution angle in order to obtain the desired bending angle actually. Therefore, where the desired bending angle $\theta$ is $\theta=180°$, for example, a reinforcing bar with $\theta=180°$ cannot be obtained unless the bending roller 72, holding the reinforcing bar between itself and the fixed guide 74, is revolved until it bites into the reinforcing bar.

After all, it is necessary only that the radius R of curvature of the approximate locus of the bending roller ranging between the maximum and minimum values $R_{max}$ and $R_{min}$ thereof, which may be obtained from the requirements (2) and (3), respectively, be within a range to fulfill the requirement (1). Generally, however, the bending angle $\theta$ hardly exceeds 135°, and $\theta=180°$ is not practical, so that the radius R of curvature may be obtained from the requirement (1) without taking $R_{max}$ and $R_{min}$ into consideration. Moreover, our experience tells that the requirements (2) and (3) never fail to be fulfilled if the requirement (1) is fulfilled. In consequence, it will be understood that only the requirement (1) need be fulfilled.

In FIG. 11, for example, a circular arc 90 (represented by one-dot chain line) with radius of curvature $\overline{O_1P}$ and center P is drawn where P corresponds to the intersection of the straight line 88 and a perpendicular bisector of a segment connecting the centers $O_1$ and $O_3$ of the bending roller at the bending angles $\theta=0°$ and 90°, respectively. The circular arc 90 is substantially coincident with the theoretically accurate locus 87 within a range $\overline{O_1O_3}$. The deviation of the center $O_{4P}$ of the bending roller 72 on the circular arc 90 from the center $O_4$ on the locus 87 at the bending angle $\theta=135°$ is negligible because it is within the tolerance (±5 mm) and in addition, the actual value of deviation is smaller than the deviation as illustrated due to the resisting force of the bent portion 85. Thus, the point P is found to be suitable for use as the bending center of the bending roller 72. If the bending guide 74 is formed into a rotatable cylinder, then resisting force will be produced between the bending guide and the workpiece, so that the actual deviation will be quite smaller than the illustrated theoretical deviation. Accordingly, the actual deviation will be able to be within the tolerance even if the illustrated deviation is twice or thrice as great as the tolerance.

According to the illustrated bending machine, as described above, the bending roller is revolved along such a curve that the contact point between the rod material 12, such as a reinforcing bar, and the bending roller 72 may be fixed on the rod material. With such construction, no slip is caused between the bending roller 72 and the rod materials 12, so that the contact portion between them is not subjected to any tensile stress, and the bending length is prohibited from increasing. Therefore, it is not necessary to clamp the rod materials 12 by means of a clamping mechanism such as a vise or to preset the bending length at a value reduced by a portion equivalent to the slippage. As a result, the accuracy of bending, as well as the operating efficiency, may be improved without making the bending machine more complicated or heavier. Moreover, the locus along which the bending roller 72 revolves can be taken as a curve on which the center of the bending roller is located also on the straight line which intersects the neutral axis of each rod material at a predetermined distance from the neutral-axis origin of the bent portion of the rod material.

Now there will be described in detail the setting of the bending angle in the bending machine 10.

Figure 12:
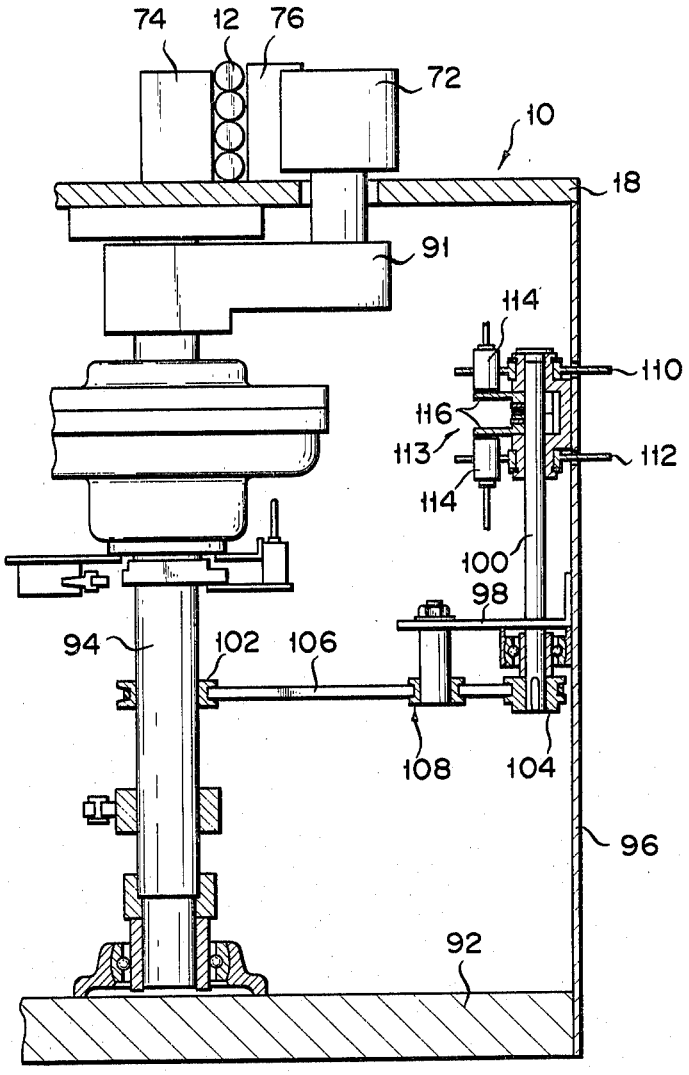
FIG. 12 is a partially sectional view of the bending machine of FIG. 1.

As seen from FIG. 12, the bending roller 72 is supported by a swinging arm 91 which is fixed on a first shaft 94 disposed on a base 92 inside the housing 18. Also, a second shaft 100 is rotatably supported by a support 98 on a side wall 96 of the housing 18. Belt-like connecting means, such as an endless belt 106, is stretched between pulleys 102 and 104 of the first and second shafts 94 and 100, and a tension pulley 108 mounted on the support 98 applies proper tension to the endless belt 106. Since the first and second shafts 94 and 100 are thus connected by the belt-like connecting means, the setting locations of the first and second shafts 94 and 100 may be selected freely. At least one, e.g. two angles setters 110 and 112 are rotatably attached to the second shaft 100 with a space left therebetween along the axial direction of the shaft 100. The angle setters 110 and 112, each having suitable angle graduations marked thereon, partially protrudes outward from the side wall 96 of the housing 18 to enable external rotating operation.

When the first shaft 94 is rotated by the driving force from the motor 78 (FIG. 1), the swinging arm 91 rotates together with the first shaft 94, thereby causing the bending roller 72 on the swinging arm 91 to perform bending operation. Inside the bending machine 10, there is provided sensor means 113 which detects the rotation of the first shaft 94 for a predetermined angle and reverses the motor to restore the first shaft 94 to its initial position in bending the reinforcing bar 12 at an angle of e.g. 90°, as shown in FIG. 6.

Figure 13A:
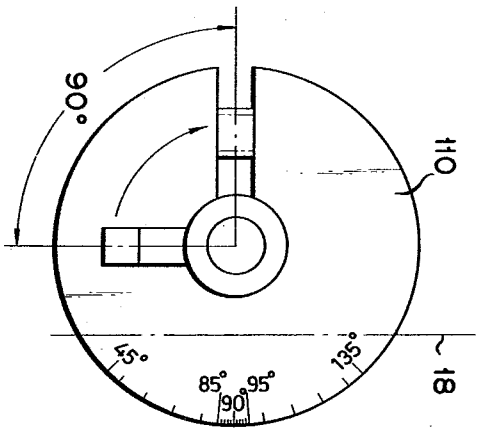
FIG. 13A is a top plan view of an angle setter which is set to a bending angle of 90°.
Figure 13B:
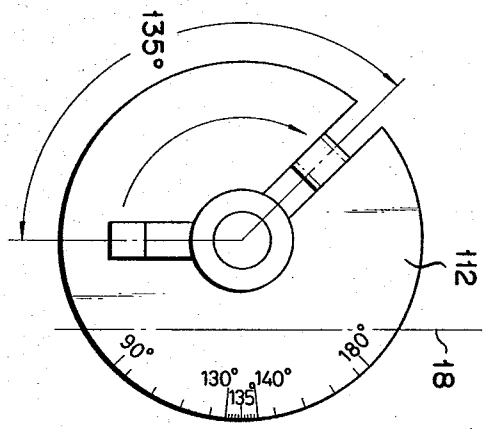
FIG. 13B is a top plan view of another angle setter which is set to a bending angle of 135°.

The sensor means 113, as shown in FIG. 12, is provided with a pair of first sensors 114 each fixed to the angle setters 110 or 112 and a pair of second sensors 116 fixed to the second shaft 100. The first and second sensors 114 and 116 may easily be formed of various combinations including a combination of a light emitting member and a light receiving member, a combination of a switch and a switch operating member such as a stopper pin, etc. Thus, the sensor means 113 detects the rotation of the second shaft 100 for the predetermined angle when the light emitting and receiving members align so that the light receiving member may receive a light signal from the light emitting member, or when the switch is changed by the switch operating member. Suppose, for example, that the angle setter 110 is set to a bending angle of 90°, as shown in FIG. 13A. At this time, the second sensor 116 on the second shaft 100 is spaced from the first sensor 114 on the angle setter 110 at a predetermined angle, e.g. 90°, along the circumferential direction. When the motor is forwardly rotated to rotate the first shaft 94, the second shaft 100 is also rotated together with the first shaft 94 by means of the endless belt 106. Also, the second sensor 116 on the second shaft 100 is rotated with the second shaft 100 as indicated by an arrow in FIG. 13A, and when the second sensor 116 is brought into alignment with the preset first sensor 114, the sensor means 113 reverses the motor to restore the first shaft 94 to its initial position. Normally, the angles of rotation of the first and second shafts 94 and 100 are not coincident with the bending angle. In FIG. 13A, nevertheless, the rotation angle of the second shaft 100 of these two shafts is coincident with the bending angle for easily understanding. When performing a bending operation with a bending angle of 135° directly after a bending operation with a bending angle of 90°, the second angle setter 112, as shown in FIG. 13B, is preset to the bending angle of 135°, for example. After the 90°-bending operation is completed, the reinforcing bars 12 are fed until they abut against the stopper 35, and then the motor is rotated again in the forward direction to rotate the first and second shafts 94 and 100. In consequence, the second sensor 116 on the second shaft 100 is rotated in the direction of an arrow of FIG. 13B. When the second sensor 116 is brought into alignment with the first sensor 114 on the angle setter 112, the motor is reversed in response to a signal transmitted from the sensor means 113 to restore the first shaft 94 to its initial position. Thus, the processing with use of the bending angle preset by the angle setters 110 and 112 is performed in order by controlling the operation of the motor by means of the signal from the sensor means to the motor. The control of the motor is executed by utilizing conventional electric circuits. When performing the 90°-bending operation after the 135°-bending operation, on the other hand, such a program is previously set that the sensor means may effectively be operated in the desired order. It is to be understood that any bending process can be achieved continuously by such programming corresponding to the proper arrangements of the angle setters.

In the illustrated embodiment, as mentioned above, the second shaft is provided separately from the first shaft on which the swinging arm is fixed, and the angle setters with angle graduations are rotatably attached to the second shaft so that the bending angle may be set by means of the angle setters. Thus, the bending angle may variably be set within a wide range. Connected by the belt-like connecting means such as an endless belt, moreover, the first and second shafts can freely be located as long as part of the angle setters protrudes from the housing, thus increasing the degree of freedom in design. Controlling the rotation of the first shaft by means of the joint action of the first and second sensors through the second shaft, furthermore, the sensor means ensures high-accuracy control. Additionally, the rotation angles of the first and second shafts will never be the same unless these shafts have the same diameter. Accordingly, the rotation angle of the second shaft, as compared with that of the first shaft, may be enlarged or reduced by suitably selecting the diameter of the second shaft. Thus, the angle setters attached to the second shaft may enjoy wide-range angle setting capable of effecting an angle of 360° or more, as well as highly accurate setting within a limited range.

Figure 14:
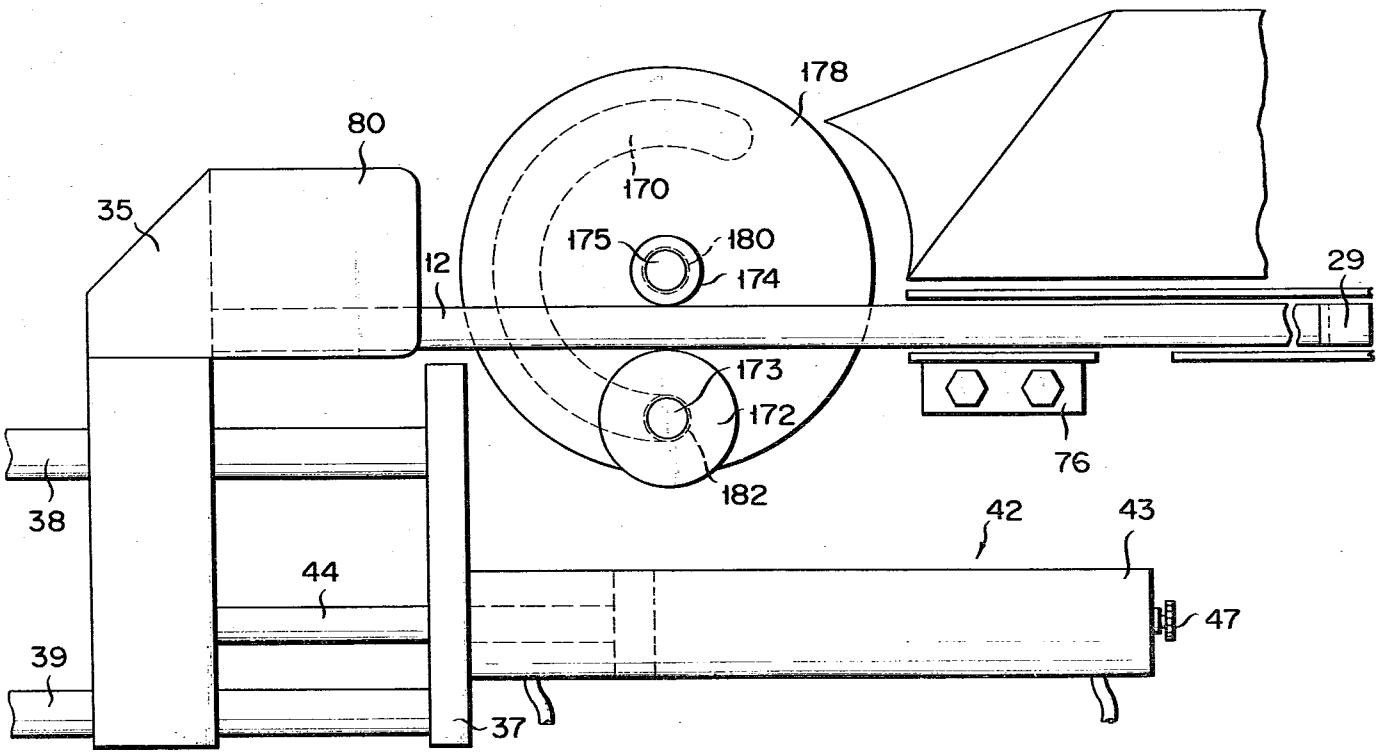
FIG. 14 is an enlarged top plan view showing part of a modified bending machine.

When bending the reinforcing bars 12, iron powder may possibly be introduced into the housing 18 through the arcuate slot 70, or otherwise, an operator may have his hand caught through carelessness between the arcuate slot 70 and the bending roller 72. In order to avoid such penetration of iron powder or accident resulting in injury, the arcuate slot 70 should preferably be covered with any suitable cover means. In a modified example shown in FIG. 14, for example, a bending roller 172 revolves around a cylindrical bending guide 174. A cover disc 178, which is disposed on the top of the housing so as to cover an arcuate slot 170, has a center hole 180 in which a shaft 175 of the bending guide 174 is loosely fitted and an eccentric hole 182 in which a shaft 173 of the bending roller 172 is loosely fitted. Accordingly, the cover disc 178 can rotate together with the shaft 173 of the bending roller 172 so as to always cover the slot 170. Despite its simplicity, these arrangements can provide satisfactory effects.

According to the method for constant-measure feed of rod materials of this invention, as described above, the feed member fixed to the conveyor means is caused to engage the rear ends of rod materials, and the rod materials are conveyed together with the feed member along the guide means. The rod materials are further conveyed while being held between the stopper located in its normal position and the feed member, and a movement of the stopper for a predetermined distance from the normal position is sensed to stop the conveying operation of the conveyor means. In such constant-measure feed method, the rod materials will be held between the feed member and the stopper to be automatically aligned even when the rod materials conveyed at a time are great in number. Therefore, it is unnecessary to true up the rear ends of the rod materials against the feed member, so that the setting of the rod materials is easy. Since the rod materials are moved as they are held between the stopper member and the feed member, those materials and members move together to allow no play to exist therebetween. Moreover, the operation of the conveyor means is stopped by sensing the movement of the stopper for the predetermined distance from its normal position at a fixed distance from the reference point, which may become a critical issue for processing, so that the feed distance of the rod materials can accurately be controlled without respect to the error in the moved distance of the conveyor means. Further, since the feed distance of the rod materials is always controlled on the basis of the normal position of the stopper even when the rod materials are fed repeatedly, there will be caused no accumulation of errors in the feed distance.

Meanwhile, the constance-measure feed mechanism used for effecting the constant-measure feed method for rod materials according to this invention comprises guide means containing and guiding rod materials, conveyor means moving along the guide means, and a feed member fixed to the conveyor means and engaging the rear ends of the rod materials when the conveyor means is forwardly moving, whereby the rod materials are moved together with the feed member along the guide means. The constant-measure feed mechanism further comprises a stopper subjected to restoring force toward a normal position to be movably disposed in the normal position and moving against the restoring force while engaging the forward ends of the rod materials moving together with the feed member and while holding the rod materials between the stopper and the feed member, and sensor means sensing a movement of the stopper for a predetermined distance from the normal position and stopping the operation of the conveyor means. With the constant-measure feed mechanism of such construction, the rod materials will be held between the feed member and the stopper to be automatically aligned even when the rod materials conveyed at a time are great in number. Since the rod materials are held between the stopper and the feed member, those materials and members may move in perfect concert with one another without any play therebetween. Moreover, the operation of the conveyor means is controlled by sensing, by means of the sensor means, not the feed distance of the conveyor means which is susceptible to errors, but the moved distance of the stopper, so that the feed distance of the rod materials can be accurately controlled. Further, since the feed distance of the rod materials is always controlled on the basis of the normal position of the stopper, there will be caused no accumulation of errors in the feed distance. Since the stopper is continually subjected to the biasing force toward its normal position, the hold of the rod materials between the stopper and the feed member can further be ensured, and the stopper can automatically be restored to the normal position after completion of a bending cycle. Preferably, a pneumatic or hydraulic cylinder unit is used for applying the biasing force to the stopper, like the case of the above-mentioned embodiment, so that the stopper may be subjected to constant biasing force independently of the moved distance of the stopper.

What is claimed is:

1. A method for constant-measure feed of rod materials comprising steps of:

bringing a feed member fixed to conveyor means into contact with the rear ends of rod materials and conveying said rod materials together with said feed member along guide means by said conveyor means;

causing the forward ends of said rod materials to abut against a movable stopper disposed in a normal position and further conveying said rod materials while holding said rod materials between said stopper and said feed member; and sensing a movement of said stopper for a predetermined distance from said normal position and stopping said conveying operation of said conveyor means.

2. A constant-measure feed mechanism for rod materials comprising:

guide means containing and guiding rod materials;

conveyor means moving along said guide means;

a feed member fixed to said conveyor means and engaging the rear ends of said rod materials when said conveyor means is conveying said rod materials, whereby said rod materials being moved together with the feed member along said guide means;

a stopper subjected to restoring force toward a normal position to be movably disposed in said normal position and moving against said restoring force while engaging the forward ends of said rod materials moving together with said feed member and while holding said rod materials between said stopper and said feed member; and sensor means for sensing a movement of said stopper for a predetermined distance from said normal position and stopping the conveying operation of said conveyor means.

3. A constant-measure feed mechanism according to claim 2, wherein said sensor means includes a slider fixed to said stopper to move therewith, and at least one movable sensing member preset in accordance with a desired feed distance and sensing a passage of said slider to stop the conveying operation of said conveyor means.

4. A constant-measure feed mechanism according to claim 3, wherein said sensing member is slidable along a scale on which the distance from a reference point for said stopper is marked.

5. A constant-measure feed mechanism according to claim 3 or 4, wherein said sensor means further includes a plurality of sensing members, a light emitting element is attached to said slider, and a light receiving element is attached to each said sensing member.

6. A constant-measure feed mechanism according to any one of claims 2 to 4, wherein said guide means is large enough to contain and guide a number of rod materials at the same time, said conveyor means is disposed in parallel with said guide means, and said feed member is fixed to said conveyor means and extends into said guide means.

7. A constant-measure feed mechanism according to claim 6, wherein said conveyor means is formed of an endless chain.

8. A constant-measure feed mechanism according to claim 6, wherein said feed member has a pressure portion to cover part of said rod materials in said guide means, thereby preventing said rod materials from escaping upward.

9. A constant-measure feed mechanism according to any one of claims 2 to 4, wherein said stopper is coupled to the free end of a piston rod of a cylinder unit, and the restoring force of said stopper is controlled by letting as required a suitable working fluid flows into a pair of chambers divided by a piston head.

10. A constant-measure feed mechanism according to claim 9, wherein said stopper has a pressure portion to cover part of said rod materials engaging said stopper, thereby preventing said rod materials from escaping upward.

11. A bending machine comprising:

a constant-measure feed mechanism for rod materials including guide means containing and guiding rod materials, conveyor means moving along said guide means, a feed member fixed to said conveyor means and engaging the rear ends of said rod materials when said conveyor means is conveying said rod materials, whereby said rod materials are moved together with the feed member along said guide means, a stopper subjected to restoring force toward a normal position to be movably disposed in said normal position and moving against said restoring force while engaging the forward ends of said rod materials moving together with said feed member and while holding said rod materials between said stopper and said feed member, and sensor means for sensing a movement of said stopper for a predetermined distance from said normal position and stopping the conveying operation of said conveyor means; and a bending mechanism including a bending roller revolving around a bending guide to bend each said rod material at a predetermined angle and a slope capable of forcing up a bent portion of said rod material bent by said bending roller, said slope being so formed as to allow the bent portion forced up by said slope to pass over the rod materials in said guide means.

12. A bending machine according to claim 11, wherein said bending roller revolves around said bending guide along such a curve that a point of contact between said bending roller and each of said rod material may be a fixed point on said rod material.

13. A bending machine according to claim 11 or 12, wherein said bending mechanism further includes bending angle regulator means comprising a second shaft coupled with a first shaft by belt-like connecting means and rotating together with said first shaft, said first shaft being fixed on a swinging arm supporting said bending roller, at least one angle setter with angle graduations rotatably attached to said second shaft and partially protruding from a housing containing said first and second shafts so that said angle setter may be rotated from outside said housing, and sensor means including at least one first sensor attached to said angle setter and at least one second sensor attached to said second shaft and detecting by means of joint action of said first and second sensors the rotation of said second shaft from an initial position thereof for an angle preset by turning said angle setter, thereby stopping the rotation of said first shaft and restoring said first shaft to said initial position.

14. A bending machine according to claim 13, wherein a plurality of angle setters are attached to said second shaft at intervals along the axial direction of said second shaft, and said sensor means includes a plurality of first sensors attached severally to said angle setters and a plurality of second sensors fixed to said second shaft adjacently to their corresponding first sensors.

15. A bending machine according to claim 14, wherein the first and second sensors of said sensor means are each formed of either a light receiving member or a light emitting member, said light receiving and light emitting members aligning so that said light receiving member may receive light from said light emitting member, thereby detecting the rotation of said second shaft for the predetermined angle.

16. A bending machine according to claim 15, wherein the first and second sensors of said sensor means are each formed of either a switch or a switch operating member, so that the rotation of said second shaft for the predetermined angle may be detected by changing said switch by means of said switch operating member.

* * * * *